US007282139B2

(12) United States Patent
Espinoza et al.

(10) Patent No.: US 7,282,139 B2
(45) Date of Patent: Oct. 16, 2007

(54) OPTIMIZATION OF GAS-TO-LIQUIDS HYDROCRACKER

(75) Inventors: Rafael L. Espinoza, Ponca City, OK (US); Keith H. Lawson, Ponca City, OK (US); Jianping Zhang, Ponca City, OK (US)

(73) Assignee: ConocoPhillips Company, Houston, TX (US)

( * ) Notice: Subject to any disclaimer, the term of this patent is extended or adjusted under 35 U.S.C. 154(b) by 652 days.

(21) Appl. No.: 10/886,249

(22) Filed: Jul. 7, 2004

(65) Prior Publication Data

US 2006/0006099 A1 Jan. 12, 2006

(51) Int. Cl.
*C10G 47/00* (2006.01)

(52) U.S. Cl. ..... 208/108; 208/950; 208/111.05; 208/111.1

(58) Field of Classification Search ..... None
See application file for complete search history.

(56) References Cited

U.S. PATENT DOCUMENTS 5,000,839 A * 3/1991 Kirker et al. ..... 208/89
5,013,422 A * 5/1991 Absil et al. ..... 208/27
5,763,716 A 6/1998 Benham et al. ..... 585/315
5,856,365 A 1/1999 Zennaro et al. ..... 518/715

OTHER PUBLICATIONS

Microsoft PowerPoint—ROukaci Current Ft Overview.ppt [online] Retrieved from the Internet:<URL http://www.cffls.uky.edu/C1/2002%20meeting/ROukaci%20Current%20FT%20Overview.pdf, Dated Aug. 4-7, 2002.

* cited by examiner

*Primary Examiner*—Tam M. Nguyen
(74) *Attorney, Agent, or Firm*—Conley Rose P.C.

(57) ABSTRACT

A method for optimal production of synthetic diesel and naphtha from a hydrocracker includes hydrocracking a synthetic heavy hydrocarbon feed comprising an α value so as to form a diesel and a naphtha; selecting a desired diesel-to-naphtha ratio; calculating, based on the feed α and the desired diesel-to-naphtha ratio, a target molar ratio of hydrocarbons exiting to hydrocarbons entering the hydrocracker; and adjusting at least one hydrocracking conversion promoting condition so as to achieve said target molar ratio. The present invention further relates to a method for adjusting the overall production of a syngas-to-synthetic hydrocarbons plant in response to market conditions, comprising adjusting at least one hydrocracking conversion promoting condition and/or at least one conversion promoting condition within a Fischer-Tropsch reactor so as to maintain the overall diesel-to-naphtha ratio or to maintain a diesel production rate within a predetermined range of a desired value.

45 Claims, 2 Drawing Sheets

OPTIMIZATION OF GAS-TO-LIQUIDS HYDROCRACKER

CROSS-REFERENCE TO RELATED APPLICATIONS

Not applicable.

STATEMENT REGARDING FEDERALLY SPONSORED RESEARCH OR DEVELOPMENT

Not applicable.

TECHNICAL FIELD OF THE INVENTION

The present invention relates to a method for optimizing cracking operation in hydrocrackers. More particularly, this invention relates to a method that provides for optimum cracking control for feeds with varying molecular weights. The present invention further relates to methods for adjusting the overall production of a plant converting syngas to synthetic hydrocarbon products in response to market conditions.

BACKGROUND

Large quantities of methane, the main component of natural gas, are available in many areas of the world, and natural gas is predicted to outlast oil reserves by a significant margin. However, most natural gas is situated in areas that are geographically remote from population and industrial centers. The costs of compression, transportation, and storage make its use economically unattractive. To improve the economics of natural gas use, much research has focused on the use of methane as a starting material for the production of higher hydrocarbons and hydrocarbon liquids, which are more easily transported and thus more economical. The conversion of methane to hydrocarbons is typically carried out in two steps. In the first step, methane is converted into a mixture of carbon monoxide and hydrogen (i.e., synthesis gas or syngas). In a second step, the syngas is converted into hydrocarbons.

This second step, the preparation of hydrocarbons from synthesis gas, is well known in the art and is usually referred to as Fischer-Tropsch synthesis, the Fischer-Tropsch process, or Fischer-Tropsch reaction(s). Fischer-Tropsch synthesis generally entails contacting a stream of synthesis gas with a catalyst under temperature and pressure conditions that allow the synthesis gas to react and form hydrocarbons. More specifically, the Fischer-Tropsch reaction is the catalytic hydrogenation of carbon monoxide to produce any of a variety of products ranging from methane to higher alkanes and aliphatic alcohols. Research continues on the development of more efficient Fischer-Tropsch catalyst systems and reaction systems that increase the selectivity for high-value hydrocarbons in the Fischer-Tropsch product stream.

The products of the Fischer-Tropsch synthesis may include a large range of molecular weights from light hydrocarbons such as methane to very large molecules with 50 or more carbon atoms. While hydrocarbon streams produced via Fischer-Tropsch synthesis may be used in a variety of applications, their use as liquid fuels is of significant interest. In particular, Fischer-Tropsch products are suitable for production of high cetane and low emissions diesel fuels. However, a significant portion of the products produced in the Fischer-Tropsch reaction are paraffin waxes that are heavier than the diesel boiling range specification and cause cold flow problems. Therefore, hydrocracking Fischer-Tropsch products is a common practice where diesel is the desired product.

Hydrocracking operations are generally controlled by monitoring the conversion of a select group of hydrocarbons. For example, it is possible to measure hydrocracker conversion by equation (1):

$$\text{Conversion} = \frac{C_{21+,IN} - C_{21+,OUT}}{C_{21+,IN}} \tag{1}$$

$C_{21+,IN}$ is the number of moles of hydrocarbons with 21 or more carbon atoms entering the reactor, and $C_{21+,OUT}$ is the number of moles of hydrocarbons with 21 or more carbon atoms exiting the reactor. This correlation is commonly used to control hydrocracker reactor severity. However, equation (1) does not provide compensation for the effect of feed composition on the cracking operation. Therefore, an improved method for controlling hydrocracking operations is needed.

SUMMARY OF THE INVENTION

The present invention provides an improved method for optimizing the operating severity of a hydrocracker for a given desired product composition and a given feed composition, as well as a method for controlling the overall production of a plant converting syngas to hydrocarbon products in response to market conditions for said hydrocarbon products.

In a preferred embodiment, the method for optimizing the operation of a hydrocracker for the production of synthetic diesel and naphtha comprising the steps of (a) providing a synthetic heavy hydrocarbon feed characterized by a 5% boiling point equal to or greater than 600° F., wherein the synthetic heavy hydrocarbon feed has a hydrocarbon composition characterized by an alpha value; (b) reacting the synthetic heavy hydrocarbon feed with hydrogen in a hydrocracker under conversion promoting conditions so as to form a hydrocracked effluent comprising a diesel and a naphtha; (c) determining the alpha value of the synthetic heavy hydrocarbon feed; (d) choosing a desired hydrocracked effluent property; (e) determining a target molar ratio of hydrocarbon molecules exiting the hydrocracker to hydrocarbon molecules entering the hydrocracker, said determination being based on the synthetic heavy hydrocarbon feed alpha value and the desired hydrocracked effluent property; and (f) adjusting at least one hydrocracker conversion promoting condition so as to approach the target molar ratio of hydrocarbon molecules exiting the hydrocracker to hydrocarbon molecules entering the hydrocracker.

In another embodiment, the method further comprises reacting a synthesis gas under conversion promoting conditions so as to form a synthetic hydrocarbon product, wherein the synthetic hydrocarbon product has a hydrocarbon composition characterized by an alpha value; determining the alpha value of said synthetic hydrocarbon product; and fractionating said synthetic hydrocarbon product so as to at least form a heavy fraction of said synthetic hydrocarbon product, wherein the heavy fraction of said synthetic hydrocarbon product is characterized by a 5% boiling point equal to or greater than 600° F.; and wherein said heavy fraction is fed to the hydrocracker.

In other embodiments, the method may include performing the steps of the method automatically in a closed-loop type operation.

In a preferred embodiment, the method includes determining a feed parameter, such as α value or average molecular weight; selecting a desired product parameter, such as diesel-to-naphtha ratio or boiling point targets; and determining a desired hydrocracker severity based on the feed parameter and product parameter. In other embodiments, the method includes changing hydrocracker operation to move toward the desired hydrocracker severity.

In some preferred embodiments, the desired product parameter is a desired hydrocracker diesel-to-naphtha weight ratio. The desired hydrocracker diesel-to-naphtha weight ratio may be between 0.6:1 and 10:1, preferably between about 1:1 to about 8:1; more preferably between about 1.5:1 to about 6.5:1; and still more preferably between about 2:1 to about 5:1.

The present invention further relates to a method for adjusting the overall production of a plant converting syngas to hydrocarbon products in response to market conditions for the hydrocarbon products, the plant comprising a Fischer-Tropsch reactor and a hydrocracker, the method comprising the steps of: (a) converting a synthesis gas comprising hydrogen and carbon monoxide in a Fischer-Tropsch reactor under conversion promoting conditions so as to form a Fischer-Tropsch hydrocarbon product comprising $C_{5+}$ hydrocarbons; wherein the Fischer-Tropsch hydrocarbon product comprises a light distillate, a middle distillate and a heavy fraction, said heavy fraction being characterized by an α value; (b) converting the heavy fraction with hydrogen in a hydrocracker under hydrocracking conversion promoting conditions so as to produce a hydrocracked effluent, wherein the hydrocracked effluent comprises a middle distillate and a light distillate, and the hydrocracked effluent is characterized by a hydrocracker middle distillate-to-light distillate weight ratio; (c) periodically determining an overall middle distillate-to-light distillate ratio for the plant based on the ratio of the total production rate of the middle distillates from steps (a) and (b) over the total production rate of the light distillates from steps (a) and (b); (d) selecting a desired overall middle distillate-to-light distillate ratio; (e) maintaining the overall middle distillate-to-light distillate ratio within a predetermined range of the desired overall middle distillate-to-light distillate ratio by adjusting either or both of: 1) at least one hydrocracking conversion promoting condition within the hydrocracker so as to effect a change in the hydrocracker middle distillate-to-light distillate ratio; and 2) at least one conversion promoting condition within the Fischer-Tropsch reactor so as to effect a change in the α value of the heavy fraction.

In preferred embodiments of the method for adjusting the overall production, step (e) comprises the hydrocracking conversion promoting condition being selected from the group consisting of hydrocracking temperature; hydrocracking pressure; hydrogen flow per volume of hydrocarbon feed; liquid hourly space velocity; and any combination of two or more thereof. Step (e) further comprises the conversion promoting condition within the Fischer-Tropsch reactor being selected from the group consisting of reactor temperature; inlet hydrogen-to-carbon monoxide molar ratio; reactor pressure; recycle ratio; reactor per-pass conversion; gas hourly space velocity; and any combination of two or more thereof. Some embodiments of the method include adjusting at least one hydrocracking conversion promoting condition and adjusting at least one conversion promoting condition within the Fischer-Tropsch reactor. Both adjustments could be done simultaneously or in a sequential manner.

In preferred embodiments of the method for adjusting the overall production of a plant converting syngas to hydrocarbon products, the light distillate and middle distillate are a naphtha and a diesel, respectively. The desired overall diesel-to-naphtha ratio is preferably a weight ratio between about 1:1 to about 5:1, preferably between about 1.4:1 to about 4:1.

In alternate embodiments, the method for controlling the overall production comprises maintaining the overall middle distillate production rate for the plant within a desired value depending on market demand. For example, steps (c) to (e) could comprise c) periodically determining an overall middle distillate production rate for the plant based on the combined production rates of middle distillates from steps (a) and (b); d) selecting a desired overall middle distillate production rate; e) maintaining the overall middle distillate production rate within a predetermined range of the desired overall middle distillate production rate by adjusting either or both of: 1) at least one hydrocracking conversion promoting condition within the hydrocracker so as to effect a change in the hydrocracker middle distillate production rate; and 2) at least one conversion promoting condition within the Fischer-Tropsch reactor so as to effect a change in the Fischer-Tropsch middle distillate production rate. The production rates could be based on volumetric flow rates or mass flow rates. Preferred embodiments include the middle distillate being a synthetic diesel fuel or a diesel blending stock.

Alternatively, the method for controlling the overall production may comprise maintaining the overall light distillate production rate for the plant within a desired value depending on market demand. Preferred embodiments include the light distillate being a synthetic naphtha.

Other embodiments are within the spirit of the present invention and are disclosed herein or will be readily understood by those of ordinary skill in the art. All of these and other embodiments, features and advantages of the present invention will become apparent with reference to the following detailed description and drawings.

BRIEF DESCRIPTION OF THE DRAWINGS

For a detailed description of the preferred embodiments of the present invention, reference will now be made to the accompanying Figures, wherein.

NOTATION, NOMENCLATURE, AND DEFINITIONS

Figure 1:
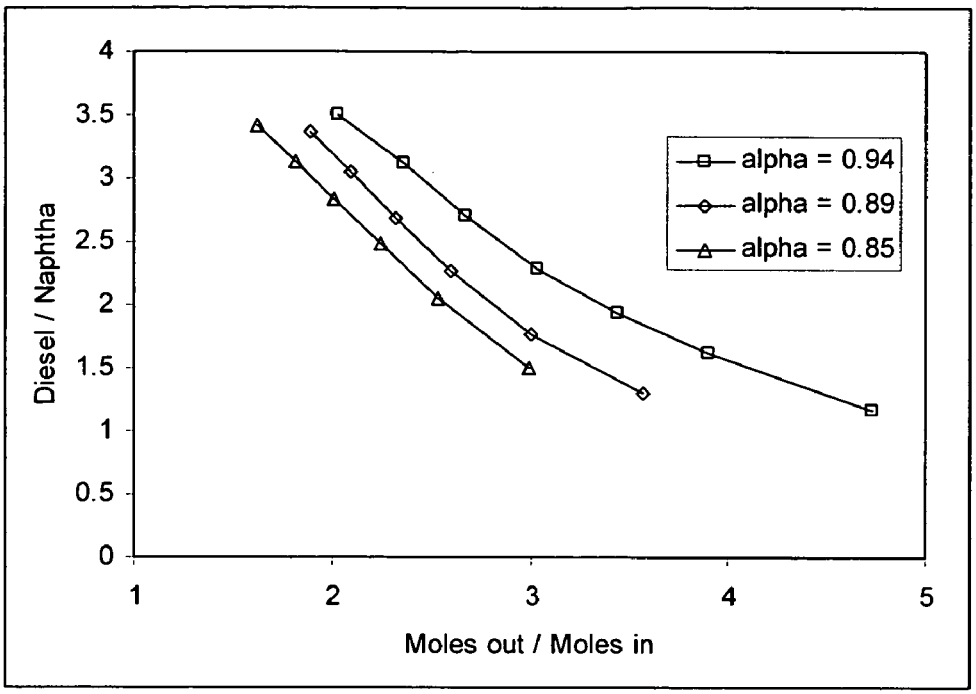
FIG. 1 is a plot of diesel-to-naphtha ratio versus hydrocracking severity (moles out/moles in) at various feed α values.

Certain terms are used throughout the following description and claims to refer to particular system components. As one skilled in the art will appreciate, individuals and companies may refer to a component by different names. This document does not intend to distinguish between components that differ in name but not function. The terms used herein are intended to have their customary and ordinary meaning. The disclosure should not be interpreted as disclaiming any portion of a term's ordinary meaning. Rather, unless specifically stated otherwise, definitions or descriptions disclosed herein are intended to supplement, i.e., be in addition to, the scope of the ordinary and customary meaning of the term or phrase.

As used herein, a "hydrocarbon" encompasses not only molecules containing only hydrogen and carbon, but also molecules containing hydrogen, carbon, and other atoms, such as oxygen, sulfur, and nitrogen.

As used herein, a "$C_n$ hydrocarbon" represents a hydrocarbon with "n" carbon atoms, and "$C_{n+}$ hydrocarbons" represents hydrocarbons with "n" or more carbon atoms; and "$C_m$-hydrocarbon" represents hydrocarbons with "m" or less carbon atoms.

As used herein, to "hydroprocess" means to treat a hydrocarbon stream with hydrogen.

As used herein, to "hydrotreat" generally refers to the saturation of unsaturated carbon-carbon bonds and removal of heteroatoms (oxygen, sulfur, nitrogen) from heteroatomic compounds. To "hydrotreat" means to treat a hydrocarbon stream with hydrogen without making any substantial change to the carbon backbone of the molecules in the hydrocarbon stream. For example, hydrotreating a hydrocarbon stream comprising predominantly an alkene with an unsaturated C═C bond in the alpha position (first carbon-carbon bond in the carbon chain) would yield a hydrocarbon stream comprising predominantly the corresponding alkane (e.g., for hydrotreating of alpha-pentene, the ensuing reaction follows: $H_2C{=}CH{-}CH_2{-}CH_2{-}CH_3+H_2 \rightarrow CH_3{-}CH_2{-}CH_2{-}CH_2{-}CH_3$).

As used herein, to "hydroisomerize" means to convert at least a portion of hydrocarbons to more branched hydrocarbons. An example of hydroisomerization comprises the conversion of linear paraffins into isoparaffins. Another example of hydroisomerization comprises the conversion of monobranched paraffins into dibranched paraffins.

As used herein, to "hydrocrack" generally refers to the breaking down of high molecular weight material into lower molecular weight material. To "hydrocrack" means to split an organic molecule with hydrogen to the resulting molecular fragments to form two smaller organic molecules (e.g., for hydrocracking of n-decane, the exemplary reaction follows: $C_{10}H_{22}+H_2 \rightarrow C_4H_{10}$ and skeletal isomers+$C_6H_{14}$ and skeletal isomers). Because a hydrocracking catalyst can be active in hydroisomerization, there can be some skeletal isomerization during the hydrocracking step, therefore isomers of the smaller hydrocarbons can be formed.

As used herein, the boiling range distribution and specific boiling points for a hydrocarbon stream or fraction heavier than the diesel boiling range (i.e., for samples that are likely to have distillations extending above 700° F.) are generally determined by the SimDis method of the American Society for Testing and Materials (ASTM) D2887 "*Boiling Range Distribution of Petroleum Fractions by GC*", unless otherwise stated. The test method ASTM D2887 is applicable to fractions having a final boiling point of 538° C. (1000° F.) or lower at atmospheric pressure as measured by this test method. This test method is limited to samples having a boiling range greater than 55° C. (100° F.), and having a vapor pressure sufficiently low to permit sampling at ambient temperature. The ASTM D2887 method typically covers the boiling range of the n-paraffins having a number of carbon atoms between about 5 and 44. Further, it should be understood by those of ordinary skill in the art that a fraction or stream of a particular set of hydrocarbons will exhibit a certain identity. The identity will generally be defined as is done herein by boiling point ranges. Other characteristics may set apart a particular fraction's identity as may be discussed herein, e.g., carbon number, degree of isomerization, etc.

As used herein, the boiling range distribution and specific boiling points for a hydrocarbon stream or fraction within the naphtha boiling range or middle distillate boiling range are generally determined by the ASTM D 86 standard distillation method "*Standard Test Method for Distillation of Petroleum Products at Atmospheric Pressure*", unless otherwise stated and except as noted above with respect to the ASTM D2887 test method (for hydrocarbon samples with boiling ranges extending above 700° F.).

As used herein, a "diesel" is any hydrocarbon cut having at least a portion that falls within the diesel boiling range. The diesel boiling range in this application includes hydrocarbons, which boil in the range of about 300° F. to about 750° F. (about 150-400° C.), preferably in the range of about 350° F. to about 650° F. (about 170-350° C.).

As used herein, a "light distillate" means a hydrocarbon stream that is generally substantially liquid at room temperature and generally higher in boiling range than a middle distillate as defined below.

As used herein, a "middle distillate" means a hydrocarbon stream which includes kerosene, home heating oil, range oil, stove oil, and diesel that has a 50 percent boiling point in the ASTM D86 standard distillation test falling between 371° F. and 700° F. (about 188-370° C.).

As used herein, a "portion of a stream" represents a split-stream or other divided part of said stream, such that the compositions of the portion and the stream are substantially the same.

As used herein, a "fraction of a stream" results from the separation by distillation of said stream, such that the compositions of the fraction and the stream are substantially different. As used herein, the boiling range distribution and specific boiling points for a hydrocarbon stream or fraction within the naphtha boiling range are generally determined by the American Society for Testing and Materials (ASTM) D-86 method "Standard Test Method for Distillation of Petroleum Products at Atmospheric Pressure," unless otherwise stated.

It should be understood by those of ordinary skill in the art that producing a fraction with hydrocarbons comprising definite carbon number cutoffs, e.g., $C_4$-$C_8$ or $C_4$-$C_{11}$, may typically be very difficult and expensive, although not impossible. The reality, especially in industrial settings, is that a distillation process targeting a cutoff of a specified carbon number or temperature may contain a small amount of material above or below the target that becomes entrained into the fraction for various reasons. For example, no two fractions of "naphtha" are exactly the same, however, it still is designated and sold as "naphtha." It is therefore intended that these explicitly specified fractions may contain a small amount of other material. The amount outside the targeted range will generally be determined by how much time and expense the user is willing to expend and/or by the limitations of the type of fractionation technique or equipment available.

DETAILED DESCRIPTION OF PREFERRED EMBODIMENTS

An embodiment of the present invention involves optimizing hydrocracker operation to achieve desired product compositions. In particular, a feed parameter may be measured, such as feed composition. From feed composition, a feed parameter, such as α, may be determined. Additionally, a preferred product composition may be selected. For example, a desired diesel/naphtha ratio may be determined. The desired diesel/naphtha ratio and the α may be used to determine a desired conversion target. The conversion target may be used to change various operating parameters of a hydrocracker in order to achieve the preferred product composition.

Typically, in the Fischer-Tropsch synthesis, the distribution of molecular weights that is observed such as for $C_{5+}$ hydrocarbon products, can be described by likening the Fischer-Tropsch reaction to a polymerization reaction with an Anderson-Shultz-Flory chain growth probability (α) that is independent of the number of carbon atoms in the lengthening molecule. Thus, a range of hydrocarbons from $C_1$ to $C_{100+}$ may be formed, with a selectivity that depends on α. In particular, the selectivity to heavy hydrocarbon products is typically characterized by a high α value. A value of α of at least 0.72 is preferred for producing high carbon-length hydrocarbons, such as those of diesel fractions and higher molecular weights. A value of α of at least 0.85 is preferred for producing a high yield of waxy hydrocarbons, such as those comprising between about 20 and more carbon atoms.

The α value is generally defined according to equation (2) as developed by Anderson-Schultz-Flory to describe the hydrocarbon chain length probability in the Fischer-Tropsch synthesis.

$$\alpha = \frac{\phi^{n+1}}{\phi^{n}} \tag{2}$$

Thus, α generally represents the ratio of the number of moles in a product mixture of products having n+1 carbon atoms, $\phi^{n+1}$, to the number of moles of products having n carbon atoms, $\phi^{n}$. Distributions of products may differ, however, for different catalysts. For example, generally the products of a Fischer-Tropsch synthesis using an iron catalyst may be characterized by two different values of α. A first value of α may apply to the range of molecules comprising from about $C_2$ to about $C_9$ or $C_{10}$, and a second value of a may apply to the range of molecules comprising from about $C_9$ or $C_{10}$ to $C_{100+}$. It is important to note that generally $C_1$ and $C_2$ do not fit within the correlation for the first α value in that generally there will be more $C_1$ than predicted and less $C_2$ than predicted. Moreover, at higher temperatures with iron catalyst, the difference in the values of the first α and the second α is less significant. Similarly, when cobalt catalyst is used in the Fischer-Tropsch process, a single value of α may generally be used to describe the entire distribution of hydrocarbons, with the exception of $C_1$ and $C_2$ as noted above.

As α value increases, generally the molecular weight of a product distribution increases—i.e., more of the longer chain hydrocarbons are present. As α approaches 1, the number of moles of hydrocarbons of all carbon chain lengths approaches equality. When α is less than 1, the quantity of higher carbon number molecules is lower relative to the quantity of molecules having fewer carbon atoms. With reference to FIG. 1, for a given quantity of cracking efficiency (moles out/moles in), products with higher α values yield more middle distillates relative to light distillates because the carbon chains in the higher α value products were longer before the cracking began. Thus, a more severe cracking operation (or a greater quantity of cracking events) would be required to generate the same ratio of middle distillates to light distillates (e.g. diesel/naphtha ratio) that could be generated with less severe cracking in a lower a value product.

Figure 2:
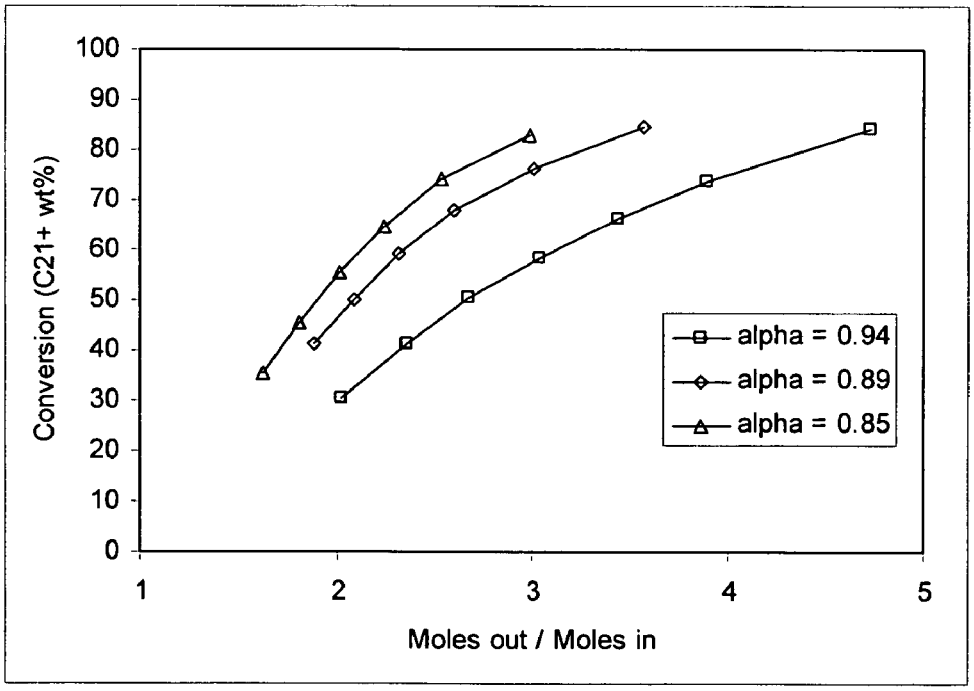
FIG. 2 is a plot of $C_{21+}$ conversion according to equation (1) above versus hydrocracking severity (moles out/moles in) at various feed α values.

The conventional model of conversion (equation (1) above) does not adequately predict the outcome of the hydrocracking operation where the feed α value may change, such as when hydrocracking products of the Fischer-Tropsch synthesis. With reference to FIG. 2, the effect of α value on actual quantity of cracking can be seen. For a given conversion, a higher α value product requires a more severe cracking operation as can be seen from the ratio of moles out/moles in. If a particular product is desired, such as a middle distillate, monitoring only conversion in the conventional sense can lead to inefficient operation and loss of valuable product. With reference to FIG. 1, if a middle distillate, such as diesel, is a preferred product, the operating region toward the right of the graph is preferred. For example, if a diesel/naphtha ratio of 2 or more is preferred, the cracking severity may range from a ratio of about 3.4 moles out/mole in at an α of 0.94 to a ratio of about 2.5 moles out/mole in at an α of 0.84. Looking again at FIG. 2, the conventional conversion would be about 77% at an α of 0.94 and about 65% at an α of 0.84 to achieve the same diesel/naphtha ratio. If the higher α product were treated to the same conversion of about 77%, the diesel/naphtha ratio would drop to about 1.7, indicating a loss of valuable product.

Figure 3:
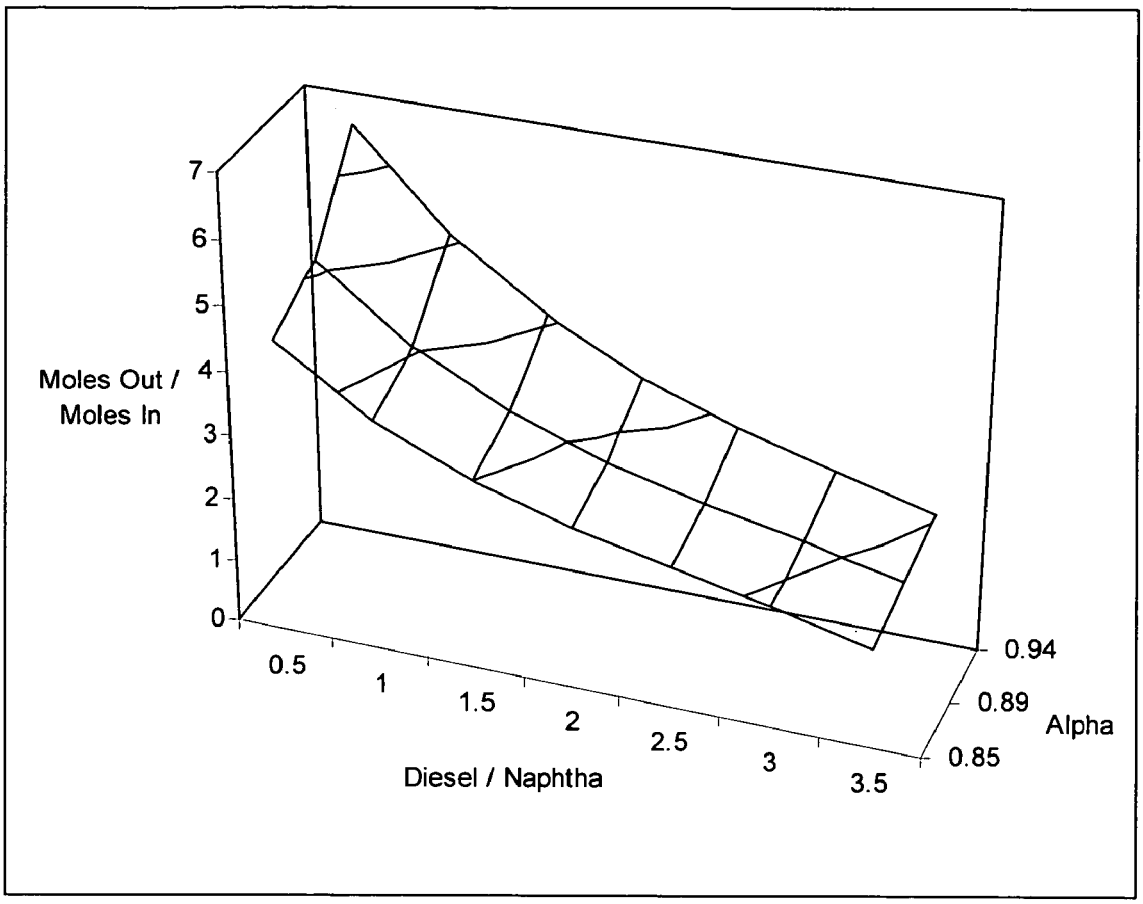
FIG. 3 is a three-dimensional plot illustrating the hydrocracking severity (moles out/moles in) of a hydrocracker based on feed α value and diesel-to-naphtha molar ratio.

It is important to note that the value of a used in FIGS. 1-3 should be the value attributable to the $C_{9+}$ or $C_{10+}$ range of hydrocarbons if more than one value of α is necessary to accurately describe the hydrocarbon distribution. Where a single value of α is adequate to describe the hydrocarbon distribution, that value of α should be used. Thus, when the term α is used in the claims, it should be understood to refer to: (1) the α applicable to the $C_{9+}$ or $C_{10+}$ hydrocarbon distribution if two values of α are necessary to completely describe the distribution or (2) the single value of α where a single value adequately describes the hydrocarbon distribution.

Therefore, when hydrocracking Fischer-Tropsch products in particular, it is important to consider the feed properties in determining the proper hydrocracking severity. In the Fischer Tropsch context, an important feed property may be the α value. However, when hydrocracking other products, other feed properties may be important. Even when hydrocracking Fischer-Tropsch products, other feed parameters may be used, such as average molecular weight, average gravity, pour point, or other properties that indicate the product distribution. Based on the α value and a desired product composition, a target conversion can be selected from FIGS. 1 and 2. Specifically, with reference to FIG. 1, the α value of the feed and diesel-to-naphtha weight ratio may be used to determine a desired quantity of hydrocracking (i.e., moles out/moles in). That hydrocracking quantity and the α value may be used to determine a desired $C_{21+}$ conversion with FIG. 2. The $C_{21+}$ conversion provides a measurable target that may be monitored to determine how closely the actual operation is approaching the desired target.

Generally, when hydrocracking a Fischer-Tropsch product, the preferred quantity of hydrocracking is about 2 to about 5 moles out/mole in. Although this quantity is determined in the above-described manner, the recited range is generally the appropriate result when a diesel product is the preferred product and a Fischer-Tropsch product is the starting material.

In this particular embodiment, the product parameter used is the diesel/naphtha weight ratio. However, other measures of product composition could similarly be used. For example, an average product molecular weight, average product gravity, product distillation, or other criteria may be used to adjust product parameters as desired. Moreover, other products may be desired, such as naphtha. The same procedure may be used to optimize naphtha production by selecting a different product composition value. Where a diesel-to-naphtha weight ratio is used in the context of hydrocracking Fischer-Tropsch products, diesel-to-naphtha weight ratios of about 0.6 to about 10 are preferred; more preferably between 1 and 8; still more preferably between 1.5 and 6.5; and yet still more preferably between 2 and 5. In alternate embodiments, the diesel-to-naphtha weight ratio is between about 0.6 to about 3.5.

Once appropriate parameters are selected, a set of figures similar to FIGS. 1 and 2 can be generated by brief experimentation to determine the appropriate relationships. Alternatively, a figure similar to FIG. 3 may be generated. FIG. 3 encompasses the information provided in both FIGS. 1 and 2 in a single 3-D graph. The product composition parameter may be selected, and the feed composition parameter may be determined. Upon determination of the product composition parameter and the feed composition parameter, an appropriate operating target may be determined. The operating target may be conventional hydrocracking conversion, or it may be some other measure of hydrocracking severity. The operation of the hydrocracker can then be adjusted to attempt to meet the operating target, such as by increasing or decreasing reaction temperature in the hydrocracking reactor, by changing space velocity, or by adjusting other parameters that affect hydrocracking conversion.

Further, the process may be automated. For example, a closed-loop system may be created by which some property of the incoming feed stream is measured. The property value may then be transmitted to a computer where that measurement is correlated with a preselected product property, such as diesel-to-naphtha ratio. The computer may then calculate an appropriate operating target to achieve the preselected product property, and the computer may automatically change certain hydrocracker operating targets or setpoints in order to move toward the appropriate operating target. The computer may perform this measurement and target-setting procedure repeatedly and automatically adjust hydrocracker operation based on its measurements and calculations as in a closed-loop system. Alternatively, the computer may simply generate a guideline for an operator to use in making adjustments to the hydrocracker operation. In still another embodiment, the computer may simply require that an operator assent to its proposed changes. Implementation of these and other process control methods for utilizing various embodiments of the present invention will be readily apparent to those of ordinary skill in the art.

The catalysts and operating parameters for hydrocrackers are well known in the art. Generally, hydrocracking takes place in a hydrocracking zone in the presence of a hydrocracking catalyst, wherein a hydrocarbon feedstream and hydrogen are passed over the hydrocracking catalyst under suitable conversion promoting conditions so as to react some of the hydrocarbon components with hydrogen and to form the hydrocracked product. The hydrocracking catalyst may contain one or more additional types of catalyst for pretreating the hydrocarbon feedstream to the catalyst bed or for different hydroprocessing functions. The hydrocracking catalyst preferably comprises a hydrogenation component and a cracking component (typically an acid component). The hydrogenation component may include a metal selected from the group consisting of platinum (Pt), palladium (Pd), nickel (Ni), cobalt (Co), tungsten (W), molybdenum (Mo), and any combination of two or more thereof. The hydrogenation component in the hydrocracking catalysts preferably includes Pt, Pd, or other metals from Groups 6, 8, 9, and 10 of the Periodic Table, including combinations such as platinum-palladium, nickel-molybdenum, cobalt-molybdenum or nickel-tungsten. The cracking component for the hydrocracking catalyst may be a zeolitic material, or an inorganic oxide. A suitable cracking component comprises alumina, silica, zirconia, magnesia, thoria, or any combinations thereof, such as an amorphous silica-alumina; however Y-type zeolite, SAPO-type molecular sieves (SAPO-11; -31; -37; -41), ZSM-type zeolites (ZSM-5; -11; -48), and dealuminated zeolites may also be used as the cracking component. The cracking component may support the hydrogenation component; however the hydrocracking catalyst may further comprise a binder, which supports both the hydrogenation component and the cracking component. Design of hydrocracking zones is well known to one having ordinary skill in the art.

Catalyst selection and appropriate operating conditions for hydrocracking are also well known to one having ordinary skill in the art. The conversion promoting conditions in the hydrocracking zone are preferably at a temperature of about 500° F. to about 750° F. (260-400° C.) and at a pressure of about 500 psig to about 1500 psig (3.5-10.5 MPa), an overall hydrogen consumption of 100-1,000 standard cubic feet per barrel of hydrocarbon feed (scf $H_2$/bbl HC) [about 17-170 STP $m^3$ $H_2/m^3$ HC feed], preferably 100-800 scf $H_2$/bbl HC, more preferably 150-700 scf $H_2$/bbl HC, still more preferably 200-500 scf $H_2$/bbl HC, a hydrogen flow between about 100 standard cubic feet of hydrogen per barrel of hydrocarbon feed and about 10,000 scf $H_2$/bbl HC, preferably between about 100 scf $H_2$/bbl HC and about 6,000 scf $H_2$/bbl HC, and using liquid hourly space velocities based on the hydrocarbon feedstock of about 0.1 to about 10 $hr^{-1}$, preferably between about 0.25 to 5 $hr^{-1}$.

In a preferred embodiment, hydrocracking takes place over a platinum or palladium catalyst preferably supported on a structured silica-alumina material such as a zeolite (i.e., ZSM-5) or an amorphous silica-alumina at a temperature of about 500° F. to about 750° F. (260-400° C.) and at a pressure of about 500 psig to about 1500 psig (3.5-10.5 MPa), with a hydrogen flow between about 100 standard cubic feet of hydrogen per barrel of hydrocarbon feed and about 10,000 scf $H_2$/bbl HC, preferably between about 100 scf $H_2$/bbl HC and about 6,000 scf $H_2$/bbl HC.

The hydrocarbon feedstream to the hydrocracking unit preferably comprises a hydrocarbon fraction from a hydrocarbon synthesis process, such as the Fischer-Tropsch synthesis. The hydrocarbon fraction may be obtained by feeding a hydrocarbon synthesis product stream to a fractionator in order for its components to be separated based on their boiling point, so as to generate various hydrocarbon fractions of different boiling ranges, wherein at least one waxy fraction can be employed as a feedstream to the hydrocracking unit. A synthetic heavy fraction suitable as a feedstream to the hydrocracking zone preferably comprises hydrocarbons with a boiling range comprising a 5% boiling point equal to or greater than about 600° F. (representing hydrocarbons with about 20 or more carbon atoms or "$C_{20+}$ hydrocarbons"), preferably equal to or greater than about 640° F. In alternate embodiments, the waxy fraction may have a boiling range comprising a 5% boiling point equal to or greater than about 800° F. (representing hydrocarbons with about 30 or more carbon atoms or "$C_{30+}$ hydrocarbons"). The type of fractionator is not critical to the present invention and can comprise any fractionator technology and/or methods known in the art. One of ordinary skill in the art will readily understand the types of fractionators useful for separating liquid hydrocarbons of this nature into the various fractions described herein. For ease of discussion, and without any intention to be so limited, the fractionator can comprise a standard atmospheric fractional distillation apparatus, a short-path distillation unit and/or a vacuum distillation column, preferably at least an atmospheric distillation apparatus.

While the α value of the feed is not intended to be a limitation of the present invention, in carrying out the hydrocracking of hydrocarbon products of the Fischer-Tropsch synthesis to produce an optimum diesel product, α values in the range of about 0.85 to about 0.94 are generally preferred; α values in the range of about 0.88 to about 0.92 are generally more preferred; α values in the range of about 0.89 to about 0.91 are generally most preferred.

Additionally, various hydrocracking arrangements may be used with the present invention. For example, conventional hydrocracking reactors may be used of the packed bed type or a fluidized bed type.

The preferred hydrocarbon feedstream to the hydrocracking zone comprises primarily a heavy fraction derived from a hydrocarbon synthesis process such as the Fischer-Tropsch synthesis.

The present invention further relates to a method for adjusting the overall production of a plant converting syngas to hydrocarbon products in response to market conditions for the hydrocarbon products, said plant comprising a Fischer-Tropsch reactor and a hydrocracker. The method allows the adjustment of either or both of (1) the performance of the hydrocarbon synthesis, particularly of the product distribution by changing some conversion promoting conditions to effect a change in catalyst selectivity (alpha value); and (2) the performance of the downstream hydrocracker receiving a heavy fraction of the hydrocarbon synthesis product by changing some conversion promoting condition based on the feed and effluent properties of the unit to effect a change in product distribution. The possible adjustments of two processes (one at a time, both at once, or in sequence) by this method confers a flexibility in plant operation so as to achieve the desired product slate depending on market demand and hence maximize profitability. The market demand can be evaluated periodically, such as daily, every other day, weekly, biweekly, etc., as desired. The adjustments of the two processes are expected to be such so as not to cause excessively large fluctuations in operations of these processes, as well as those located downstream and upstream. It is expected that all of the processes in the plant (not only the Fischer-Tropsch reactor and the hydrocracker, but also the syngas generator, other hydroprocessing units, and ancillary utilities processes) will be constrained by their respective capacities and their designed operating ranges. However, it is expected that a slight change in temperature, for example of about 5° C. in the Fischer-Tropsch reactor, could result in a sufficient change in its product distribution so as to have an impact on the feed rate and feed composition to the hydrocracker, which in turn could have a significant impact on the overall product slate of the plant.

The method for adjusting the overall production of a plant converting syngas to hydrocarbon products preferably comprises the following steps of:

a) converting a synthesis gas comprising hydrogen and carbon monoxide in a Fischer-Tropsch reactor under conversion promoting conditions so as to produce a Fischer-Tropsch hydrocarbon product comprising $C_{5+}$ hydrocarbons, wherein the Fischer-Tropsch hydrocarbon product comprises a light distillate, a middle distillate and a heavy fraction, said heavy fraction being characterized by an α value;

b) converting the heavy fraction with hydrogen in a hydrocracker under hydrocracking conversion promoting conditions so as to produce a hydrocracked effluent, wherein the hydrocracked effluent comprises a middle distillate and a light distillate, and the hydrocracked effluent is characterized by a hydrocracker middle distillate-to-light distillate ratio;

c) periodically determining an overall middle distillate-to-light distillate ratio for the plant based on the ratio of the total production rate of middle distillates from steps (a) and (b) to the total production rate of light distillates from steps (a) and (b);

d) selecting a desired overall middle distillate-to-light distillate ratio;

e) maintaining the overall middle distillate-to-light distillate ratio within a predetermined range of the desired overall middle distillate-to-light distillate ratio by adjusting either or both of:

1) at least one hydrocracking conversion promoting condition within the hydrocracker so as to effect a change in the hydrocracker middle distillate-to-light distillate ratio; and 2) at least one conversion promoting condition within the Fischer-Tropsch reactor so as to effect a change in the α value of the heavy fraction.

The overall middle distillate-to-light distillate ratio of step (c) and the desired ratio of step (d) are preferably weight ratios, but could also be volumetric ratios. For example, when the overall middle distillate-to-light distillate ratio is a weight ratio, it is determined in step (c) based on the ratio of the combined middle distillate production rates from steps (a) and (b) over the combined light distillate production rates from steps (a) and (b), wherein the production rates are based on respective mass flow rates using the same unit (such as pounds per hour; kilograms per hour; tons per day; and the like). The desired overall middle distillate-to-light distillate ratio is preferably a weight ratio greater than 1:1, more preferably between about 1:1 and about 5:1; still more preferably between about 1.4:1 and about 4:1; while the hydrocracker middle distillate-to-light distillate ratio is a weight ratio between about 0.6:1 and about 10:1; more preferably between about 1:1 and about 8:1; still more preferably between about 1.5:1 and about 6.5:1; yet still more preferably between about 2.5:1 and about 5:1. The predetermined range could be in percentage term within 10% of the desired overall middle distillate-to-light distillate ratio, preferably within 8%; more preferably within 5%; still more preferably within 2%; yet still more preferably within 1%.

When step (e) comprises adjusting at least one conversion promoting condition within the Fischer-Tropsch reactor so as to effect a change in the α value of the heavy fraction, it is to be understood that a change in the α value of the heavy fraction would also result in changing the feed rate to the hydrocracker. Hence the Applicants expect that changes to the α value will be moderate, i.e., not more than 0.02, preferably less than 0.01; more preferably less than 0.007, and still more preferably less than 0.005. In some cases, the change to the α value will be less than about 1.2%, preferably less than about 0.8%; more preferably less than about 0.6%. For example, at least one conversion promoting condition within the Fischer-Tropsch reactor could be adjusted so as to increase the $\alpha$ value from 0.9 to 0.901; 0.903; 0.905 or 0.91; as a result of the increased $\alpha$ value, the feed rate to the hydrocracker is increased by 1.6%; 5%, 8% and 17%, respectively. The maximum allowed change in alpha value could be dictated in part by the mimimum/maximum designed capacities of the hydrocracker as well as the ranges of designed operating conditions for both hydrocracker and the Fischer-Tropsch reactor.

When step (e) comprises at least one hydrocracking conversion promoting condition within the hydrocracker so as to effect a change in the hydrocracker middle distillate-to-light distillate ratio, it is to be understood that a change in the hydrocracker conversion (resulting in a change in middle distillate-to-light distillate ratio) would also result in changing the diesel selectivity of the hydrocracker. Hence, the Applicants expect that changes in the hydrocracker conversion will be moderate so as not to exceed a hydrocracker diesel selectivity beyond what the hydrocracker can achieve, i.e., the hydrocracker diesel selectivity is expected not to exceed 87%, and is preferably between 60% and 85%, more preferably between about 70% and about 80%.

In some preferred embodiments, step (e) of the method comprises adjusting at least one hydrocracking conversion promoting condition selected from the group consisting of hydrocracking temperature; hydrocracking pressure; hydrogen flow per volume of hydrocarbon feed; and liquid hourly space velocity. The hydrocracking conversion promoting condition preferably comprises a hydrocracking temperature between about 260° C. and about 400° C.; a hydrocracking pressure between about 500 psig to about 1500 psig; a hydrogen flow between about 100 standard cubic feet of hydrogen per barrel of hydrocarbon feed (scf $H_2$/bbl HC) and about 10,000 scf $H_2$/bbl HC, more preferably between about 100 and about 6,000 scf $H_2$/bbl HC; and a liquid hourly space velocity between 0.1 and 10 $hr^{-1}$, more preferably between 0.5 and 5 $hr^{-1}$.

In some other embodiments, step (e) of the method comprises adjusting at least one conversion promoting condition within the Fischer-Tropsch reactor, said conversion promoting condition being selected from the group consisting of reactor temperature; inlet hydrogen-to-carbon monoxide molar ratio; reactor pressure; recycle ratio; reactor per-pass CO conversion; gas hourly space velocity; and any combination thereof. The conversion promoting conditions within the Fischer-Tropsch reactor preferably comprise a reactor temperature between 160° C. and 300° C.; more preferably between 190° C. and 260° C., still more preferably between 205° C. and 230° C.; a reactor pressure between 140 psig and 750 psig, more preferably between 250 psig and 650 psig; a feed hydrogen-to-carbon monoxide molar ratio between 1.4:1 and 2.3:1, more preferably between 1.7:1 and 2.2:1; a recycle volumetric ratio of recycle-to-fresh feed between about 0.1:1 and about 10:1, more preferably between about 0.2:1 and about 2:1; and a reactor per-pass CO conversion between 30% and 70%, more preferably between 35% and 65%.

Alternate embodiments of the method include adjusting at least one hydrocracking conversion promoting condition and adjusting at least one conversion promoting condition within the Fischer-Tropsch reactor. The two adjustments could be done simultaneously or in a sequential manner.

Preferred embodiments include the middle distillate being a diesel fuel and the light distillate being a naphtha. The desired overall diesel-to-naphtha ratio and the hydrocracker diesel-to-naphtha ratio can be volumetric ratios, but preferably are weight ratios. The desired overall diesel-to-naphtha weight ratio is preferably greater than 1:1, more preferably between about 1:1 and about 5:1; still more preferably between about 1.4:1 and about 4:1; while the hydrocracker diesel-to-naphtha ratio is preferably a weight ratio between about 0.6:1 and about 10:1; preferably between about 1:1 and about 8:1; more preferably between about 1.5:1 and about 6.5:1; still more preferably between about 2.5:1 and about 5:1.

In alternate embodiments, the method for controlling the overall production comprises maintaining the overall middle distillate production rate for the plant within a desired value depending on market demand. For example, the alternate method could comprise the following steps of:

a) converting a synthesis gas comprising hydrogen and carbon monoxide in a Fischer-Tropsch reactor under conversion promoting conditions so as to produce a Fischer-Tropsch hydrocarbon product comprising $C_5^+$ hydrocarbons, wherein the Fischer-Tropsch hydrocarbon product comprises a light distillate, a middle distillate and a heavy fraction, each being characterized by their respective production rate; said heavy fraction being further characterized by an $\alpha$ value;
b) converting the heavy fraction with hydrogen in a hydrocracker under hydrocracking conversion promoting conditions so as to produce a hydrocracked effluent, wherein the hydrocracked effluent comprises a middle distillate and a light distillate, and further wherein the hydrocracked middle distillate and the light distillate are characterized by their respective production rate;
c) periodically determining an overall middle distillate production rate for the plant based on the combined production rates of middle distillates from steps (a) and (b);
d) selecting a desired overall middle distillate production rate;
e) maintaining the overall middle distillate production rate within a predetermined range of the desired overall middle distillate production rate by adjusting either or both of:
   1) at least one hydrocracking conversion promoting condition within the hydrocracker so as to effect a change in the hydrocracker middle distillate production rate during step (b); and
   2) at least one conversion promoting condition within the Fischer-Tropsch reactor so as to effect a change in the Fischer-Tropsch middle distillate production rate during step (a).

Preferred embodiments include the middle distillate being a synthetic diesel fuel or a diesel blending stock. The production rate can be based on a mass flow rate (such as tons per day, kilograms per hour, pounds per hour, etc.) or a volumetric flow rate (such as barrel per day, cubic meter per day, gallons per hour, etc.). As an example of market demand, one may want to produce more middle distillate from the plant, when the price per gallon of said middle distillate is increasing. The predetermined range could be in percentage term within 10% of the desired overall middle distillate mass flow rate, preferably within 8%; more preferably within 5%; still more preferably within 3%; yet still more preferably within 2%.

Alternatively, the method for controlling the overall production may comprise maintaining the overall light distillate production rate for the plant within a desired value depending on market demand. Preferred embodiments include the light distillate being a synthetic naphtha.

In alternate embodiments, instead of step (e), the process may comprise alternate step (e2) and an additional step (f). A suitable alternate step (e2) may comprise comparing the estimated overall middle distillate-to-light distillate ratio to the desired overall middle distillate-to-light distillate ratio; while the step (f) is performed when the estimated overall middle distillate-to-light distillate ratio and the desired overall middle distillate-to-light distillate ratio differ by more than an acceptable margin, and comprises either or both of: (1) at least one hydrocracking conversion promoting condition within the hydrocracker so as to effect a change in the hydrocracker middle distillate-to-light distillate ratio; and (2) at least one conversion promoting condition within the Fischer-Tropsch reactor to effect a change in the $\alpha$ value of the heavy fraction, such that the overall middle distillate-to-light distillate ratio approaches the desired overall middle distillate-to-light distillate ratio. The hydrocracker middle distillate-to-light distillate ratio as well as the estimated and desired overall diesel-to-naphtha ratios can be volumetric ratios, but preferably are weight ratios. The acceptable margin between the estimated and desired overall middle distillate-to-light distillate weight ratios could be in absolute terms less than 0.5:1, preferably less than 0.25:1; more preferably less than 0.15:1; still more preferably less than 0.1:1; and yet still more preferably less than 0.05:1. Alternatively, the acceptable margin between the estimated and desired overall middle distillate-to-light distillate ratios could be in percentage terms less than 10%, preferably less than 8%; more preferably less than 5%; still more preferably less than 2%; yet still more preferably less than 1%.

Another suitable alternate step (e2) may comprise comparing the overall middle distillate-to-light distillate ratio to the desired overall middle distillate-to-light distillate ratio; while the method may further comprise a step (f) when the overall middle distillate-to-light distillate ratio and the desired overall middle distillate-to-light distillate ratio differ by more than a predetermined amount, wherein step (f) may comprise adjusting either or both of: (1) at least one hydrocracking conversion promoting condition within the hydrocracker so as to effect a change in the hydrocracker middle distillate-to-light distillate ratio; and (2) at least one conversion promoting condition within the Fischer-Tropsch reactor to effect a change in the $\alpha$ value of the heavy fraction; such that the overall middle distillate-to-light distillate ratio approaches the desired overall middle distillate-to-light distillate ratio. The compared and desired overall diesel-to-naphtha ratios can be volumetric ratios, but preferably are weight ratios. The predetermined amount between the compared and desired overall middle distillate-to-light distillate weight ratios could be in absolute term less than 0.5:1, preferably less than 0.25:1; more preferably less than 0.15:1; and still more preferably less than 0.1:1; still more preferably less than 0.05:1. The predetermined amount between the estimated and desired overall middle distillate-to-light distillate ratios could be in percentage term less than 10%, preferably less than 8%; more preferably less than 5%; still more preferably less than 2%; yet still more preferably less than 1%.

Generally, in a Fischer-Tropsch process, a syngas feed (comprising hydrogen and carbon monoxide) is fed to a hydrocarbon synthesis reactor comprising a Fischer-Tropsch catalyst under conversion promoting conditions so as to convert at least a portion of the syngas to hydrocarbons, particularly $C_{5+}$ hydrocarbons.

Fischer-Tropsch catalysts typically comprise at least one primary catalytic metal from Groups 8, 9, or 10 of the Periodic Table of the Elements (according to the New Notation IUPAC Form as illustrated in, for example, the *CRC Handbook of Chemistry and Physics,* 82$^{nd}$ *Edition,* 2001-2002; said reference being the standard herein and throughout). Iron, cobalt, ruthenium, and/or nickel are among the commonly preferred metals. Additionally, the catalyst may comprise at least one promoter typically chosen from the group consisting of ruthenium, rhenium, platinum, palladium, silver, lithium, sodium, copper, boron, manganese, potassium and any combination of two or more thereof. Fischer-Tropsch catalysts may be supported or unsupported. Typical catalyst supports used in Fischer-Tropsch catalysts include any stabilized, doped, modified or unmodified inorganic oxide, such as silica, ceria, alumina, titania, thoria, boria, zirconia, or any combination of two or more thereof, such as silica-alumina. The Fischer-Tropsch catalyst is preferably a particulate supported cobalt catalyst.

The syngas feed to the hydrocarbon synthesis reactor comprises hydrogen ($H_2$) and carbon monoxide (CO), which are the reactant gases in the hydrocarbon synthesis. $H_2$/CO mixtures suitable as a feedstock for conversion to hydrocarbons in the system of this invention can be obtained from light hydrocarbons, such as methane or hydrocarbons comprised in natural gas, by means of steam reforming, autothermal reforming, dry reforming, advanced gas heated reforming, partial oxidation, catalytic partial oxidation, other processes known in the art, or any combination of two syngas processes or more thereof. Alternatively, the $H_2$/CO mixtures can be obtained from biomass, and/or from coal by gasification. In addition the syngas feed can comprise off-gas (or tail gas) recycle from the present or another Fischer-Tropsch process. It is preferred that the molar ratio of hydrogen to carbon monoxide in the syngas feed be greater than 0.5:1 (e.g., from about 0.67 to about 2.5). Preferably, when cobalt, nickel, iron, and/or ruthenium catalysts are used in the hydrocarbon synthesis reactor, the syngas feed comprises hydrogen and carbon monoxide in a molar ratio of about 1.4:1 to about 2.3:1, more preferably between about 1:7 to 2.2:1. The syngas feed may also comprise carbon dioxide. Moreover, the syngas feed preferably comprises only a low concentration of compounds or elements that have a deleterious effect on the catalyst, such as poisons. For example, the syngas feed may be pretreated to ensure that it contains low concentrations of sulfur or nitrogen compounds such as hydrogen sulfide, hydrogen cyanide, ammonia and carbonyl sulfides.

The syngas feed is contacted with the Fischer-Tropsch catalyst in a reaction zone. Mechanical arrangements of conventional design may be employed as the reaction zone including, for example, fixed bed, fluidized bed, slurry bubble column or ebullating bed reactors, among others. Accordingly, the preferred size and physical form of the catalyst particles may vary depending on the reactor in which they are to be used. In preferred embodiments, particulate Fischer-Tropsch catalysts comprising cobalt, ruthenium, or combination thereof, are used in the reaction zone. The particulate catalyst more preferably comprises cobalt as catalytic metal. The particulate catalyst most preferably comprises a supported cobalt catalyst. In most preferred embodiments, the hydrocarbon synthesis reactor comprises a slurry bubble column reactor loaded with catalyst particles of a weight average particle size between about 30 microns and 90 microns, wherein said catalyst particles comprise cobalt as a catalytically active metal and optionally one or more promoters. In the alternative embodiments, hydrocarbon synthesis reactor comprises a fixed bed reactor loaded with catalyst particles of a fresh size greater than about 250 microns, wherein said catalyst particles comprise cobalt or iron as catalytically active metal and optionally one or more promoters.

The hydrocarbon synthesis reactor is typically run in a continuous mode. In this mode, the gas hourly space velocity through the reaction zone typically may range from about 50 to about 10,000 $hr^{-1}$, preferably from about 300 $hr^{-1}$ to about 2,000 $hr^{-1}$. The gas hourly space velocity is defined as the volume of syngas feed per time per reaction zone volume. The volume of syngas feed is preferably at but not limited to standard conditions of pressure (101 kPa) and temperature (0° C.). The reaction zone volume is defined by the portion of the reaction vessel volume in which the reaction takes place and that is occupied by a gaseous phase comprising reactant gases, products and/or inerts; a liquid phase comprising liquid/wax products and/or other liquids; and a solid phase comprising catalyst. In preferred embodiments, the reaction zone comprises a slurry bubble column, wherein the slurry comprises a particulate catalyst suspended by a gas comprising reactant gases in a liquid comprising Fischer-Tropsch products. The reaction zone temperature is typically in the range from about 160° C. to about 300° C. Preferably, the reaction zone is operated at conversion promoting conditions at temperatures from about 190° C. to about 260° C., more preferably from about 205° C. to about 230° C. The reaction zone pressure is typically in the range of about 80 psia (552 kPa) to about 1,000 psia (6,900 kPa), more preferably from 80 psia (550 kPa) to about 800 psia (5,515 kPa), and still more preferably from about 140 psia (965 kPa) to about 750 psia (5,170 kPa). Most preferably, the reaction zone pressure is from about 250 psia (1,720 kPa) to about 650 psia (4,480 kPa). The per-pass CO conversion in the hydrocarbon synthesis reactor is preferably between 30% and 70%, more preferably between 35% and 65%.

The hydrocarbon synthesis product exiting the hydrocarbon synthesis reactor primarily comprises hydrocarbons. The hydrocarbon synthesis product typically comprises saturated hydrocarbons (such as paraffins), unsaturated hydrocarbons (such as olefins), and oxygenated hydrocarbons (such as alcohols, aldehydes, and the like). The hydrocarbon synthesis product typically comprises at least a light distillate and a middle distillate. It is preferred that the hydrocarbon synthesis product is hydrotreated prior to being fed to a fractionator. Hence, the hydrocarbon synthesis product is preferably fed to a hydrotreater for hydrotreatment so as to saturate the olefins in the hydrocarbon synthesis product. In addition, hydrotreatment of the hydrocarbon synthesis product can either allow a substantial amount of the oxygenates to remain unconverted or convert a substantial amount of the oxygenates to paraffins. The hydrotreatment preferably take place over hydrotreating catalysts. The hydrotreating catalysts comprise at least one of a Group 6 metal, such as molybdenum and tungsten, and/or a metal from Groups 8, 9 and 10, such as nickel, palladium, platinum, ruthenium, iron, and cobalt. The use of nickel, palladium, platinum, tungsten, molybdenum, ruthenium, and any combination of two or more thereof results in typically highly active hydrotreating catalysts, whereas the use of iron and/or cobalt results in typically less active hydrotreating catalysts. The hydrotreatment is preferably conducted at temperatures from about 80° C. to about 300° C., and the hydrotreating temperature depends on the activity of the selected hydrotreating catalyst (high or low) as well as the desired removal of the oxygenates. A high activity of the selected hydrotreating tends to lower the temperature necessary for hydrotreating. A higher temperature tends to increase the degree of removal of oxygenates. Other operating parameters of the hydrotreater may be varied by one of ordinary skill in the art to affect the desired hydrotreatment. For instance, the hydrogen partial pressure is preferably between about 690 kPa and about 6,900 kPa, and more preferably between about 2,060 kPa and about 3,450 kPa. Moreover, the liquid hourly space velocity is preferably between about 0.5 $hr^{-1}$ and about 10 $hr^{-1}$, more preferably between about 0.5 $hr^{-1}$ and about 6 $hr^{-1}$, and most preferably between about 1 $hr^{-1}$ and about 5 $hr^{-1}$.

A hydrotreated product stream leaving the hydrotreater is preferably fed to a fractionator. The fractionator feed is separated into distillation cuts, which typically include at least a light distillate, a middle distillate, and a heavy fraction, also called wax fraction as it typically contains wax hydrocarbons (i.e., $C_{20+}$ hydrocarbons). It is to be understood that the present invention can include more than one middle distillates. Methods of fractionation are well known in the art, and the fractionator feed can be fractionated by any suitable fractionation method. The fractionator preferably includes at least an atmospheric distillation column. It is to be understood that the middle distillate so obtained by fractionation can include any suitable middle distillates derived from synthesis gas. Preferably, the middle distillate comprises a middle distillate selected from the group consisting of diesel, kerosene, jet fuel, heating oil, and any mixture of two or more thereof. More preferably, the middle distillate comprises at least one Fischer-Tropsch derived fraction selected from the group consisting of diesel, kerosene, jet fuel, and any mixture of two or more thereof. More preferably, the middle distillate comprises diesel. Preferably, the middle distillate comprises a diesel with a cetane number equal to or greater than 65. More preferably, the middle distillate comprises a diesel with a cetane number equal to or greater than 70. Additionally, the middle distillate preferably has a boiling range with an initial boiling point between about 160° C. and about 180° C. and a final boiling point between about 340° C. and about 370° C.

Substantially all of the wax fraction is fed to the hydrocracker. Wax fraction feeding the hydrocracker could comprise the bottoms of an atmospheric distillation column fed which could also be fed by hydrotreated product stream; or a light wax cut or a heavy wax cut (such as vacuum bottoms) from a vacuum distillation column; or any combination thereof. Hence, in general terms, wax fraction refers to a higher boiling fraction than a diesel distillate. In some embodiments, wax fraction comprises at least 30% by weight of $C_{20+}$ hydrocarbonaceous compounds, preferably at least 50% by weight of $C_{20+}$ hydrocarbonaceous compounds, more preferably at least 70% by weight of $C_{20+}$ hydrocarbonaceous compounds. In preferred embodiments, wax fraction comprises at least 90% by weight of $C_{20+}$ hydrocarbonaceous compounds. In alternate embodiments, wax fraction comprises at least 10% by weight of $C_{30+}$ hydrocarbonaceous compounds, preferably at least 20% by weight of $C_{30+}$ hydrocarbonaceous compounds. In yet other embodiments, wax fraction comprises at least 10% by weight of $C_{40+}$ hydrocarbonaceous compounds, preferably at least 20% by weight of $C_{40+}$ hydrocarbonaceous compounds. The fractionator preferably comprises an atmospheric distillation tower, and the wax fraction preferably comprises the bottoms of said atmospheric distillation tower. The heavy fraction or wax fraction is preferably characterized by a 5% boiling point equal to or greater than 600° F.; preferably characterized by a 5% boiling point equal to or greater than 640° F.

The wax fraction is cracked in the presence of hydrogen over a catalyst under hydrocracking promoting conditions so as to form the hydrocracker effluent. Methods of hydrocracking are well known in the art, and hydrocracking of the wax fraction preferably includes the conditions and catalysts disclosed thereabove. The hydrocracker effluent preferably comprises a light distillate and a middle distillate. The hydrocracker effluent (in part or preferably in its entirety) can be fed to the same fractionator separating the hydrotreated product stream (or a different fractionator). The hydrocracker effluent can be combined with the hydrotreater product stream before entering the fractionator; or the hydrocracker effluent and the hydrotreater product stream could be fed separately to the fractionator. In this preferred embodiment, the recycle of hydrocracker effluent to ultimately the same fractionator which supplies the wax fraction to the hydrocracker can assure that substantially all of the wax hydrocarbons are recycled to extinction in the synthetic fuel production plant. In some embodiments, a purge taken from the wax fraction may be performed in order to remove some material resilient to the hydrocracking. The purge typically represents not more than about 2 percent by volume of the wax fraction, preferably less than about 1 percent by volume.

The hydrocracker could comprise a single hydrocracking vessel or a multitude of hydrocracking vessels, preferably operated in series.

The hydrocarbon synthesis reactor could comprise a single reactor vessel or a multitude of reactor vessels preferably operated in series and/or in parallel. The hydrocarbon synthesis reactor could further comprise an internal recycle loop to recycle its tail gas (comprising unconverted carbon monoxide and hydrogen) to its inlet, so as to increase the CO conversion.

EXAMPLES

The following theoretical Examples illustrate the principles and advantages of the present invention relating to the operation of a hydrocracker being fed a wax fraction derived from a hydrocarbon synthesis reactor and the overall operation of a synthetic fuel production plant comprising said hydrocracker and said hydrocarbon synthesis reactor. For the Examples, it is assumed that the middle distillate is a diesel comprising $C_{10}$-$C_{22}$ hydrocarbonaceous compounds (labeled as 'D'), the light distillate is a naphtha comprising $C_5$-$C_9$ hydrocarbonaceous compounds (labeled as 'N'), and the wax fraction comprises $C_{22+}$ hydrocarbonaceous compounds (labeled as 'W'). A model based on alpha value of the hydrocracker feed (i.e., wax fraction) and hydrocracker diesel selectivity was used to predict their impact on the hydrocracker and overall diesel-to-naphtha weight ratios (labeled as 'D/N'). It is assumed that $C_1$-$C_4$ hydrocarbons are formed during hydrocracking and represent 2 percent by weight of the weight of the wax fraction to the hydrocracker. Results of those simulations are given in Tables 1-10 below. The production rates of $C_1$-$C_4$ hydrocarbons formed during hydrocracking and during hydrocarbon synthesis (their production rate increases as the alpha value decreases) are not shown in these Tables.

TABLE 1

Alpha = 0.85

| FT hydrocarbon production (tons per day) | | Hydrocracking unit Hydrocarbon production and D/N in hydrocracking effluent (tons per day) | | | | | Overall plant unit Hydrocarbon production and D/N (tons per day) | | | | |
|---|---|---|---|---|---|---|---|---|---|---|---|
| Total C5+ | 8865 | Diesel sel.* | 85 | 80 | 70 | 60 | Diesel sel.* | 85 | 80 | 70 | 60 |
| N | 3112 | N | 187 | 259 | 403 | 547 | N | 3299 | 3371 | 3515 | 3659 |
| D | 4314 | D | 1224 | 1152 | 1008 | 864 | D | 5537 | 5465 | 5321 | 5177 |
| Wax C22+ | 1439 | D/N | 6.54 | 4.44 | 2.50 | 1.58 | D/N | 1.68 | 1.62 | 1.51 | 1.41 |

TABLE 2

Alpha = 0.89

| FT hydrocarbon production (tons per day) | | Hydrocracking unit Hydrocarbon production and D/N in hydrocracking effluent (tons per day) | | | | | Overall plant unit Hydrocarbon production and D/N (tons per day) | | | | |
|---|---|---|---|---|---|---|---|---|---|---|---|
| Total C5+ | 9331 | Diesel sel.* | 85 | 80 | 70 | 60 | Diesel sel.* | 85 | 80 | 70 | 60 |
| N | 2152 | N | 382 | 529 | 823 | 1117 | N | 2534 | 2681 | 2975 | 3269 |
| D | 4239 | D | 2499 | 2352 | 2058 | 1764 | D | 6738 | 6591 | 6297 | 6003 |
| Wax C22+ | 2940 | D/N | 6.54 | 4.44 | 2.50 | 1.58 | D/N | 2.66 | 2.46 | 2.12 | 1.84 |

TABLE 3

Alpha = 0.91

| FT hydrocarbon production (tons per day) | | Hydrocracking unit Hydrocarbon production and D/N in hydrocracking effluent (tons per day) | | | | | Overall plant unit Hydrocarbon production and D/N (tons per day) | | | | |
|---|---|---|---|---|---|---|---|---|---|---|---|
| Total C5+ | 9531 | Diesel sel.* | 85 | 80 | 70 | 60 | Diesel sel.* | 85 | 80 | 70 | 60 |
| N | 1634 | N | 527 | 730 | 1135 | 1541 | N | 2161 | 2364 | 2769 | 3175 |
| D | 3842 | D | 3447 | 3244 | 2839 | 2433 | D | 7289 | 7086 | 6680 | 6275 |
| Wax C22+ | 4055 | D/N | 6.54 | 4.44 | 2.50 | 1.58 | D/N | 3.37 | 3.00 | 2.41 | 1.98 |

TABLE 4

Alpha = 0.94

| FT hydrocarbon production (tons per day) | | Hydrocracking unit Hydrocarbon production and D/N in hydrocracking effluent (tons per day) | | | | | Overall plant unit Hydrocarbon production and D/N (tons per day) | | | | |
|---|---|---|---|---|---|---|---|---|---|---|---|
| Total C5+ | 9776 | Diesel sel.* | 85 | 80 | 70 | 60 | Diesel sel.* | 85 | 80 | 70 | 60 |
| N | 877 | N | 806 | 1117 | 1737 | 2357 | N | 1684 | 1994 | 2614 | 3235 |
| D | 2695 | D | 5273 | 4963 | 4342 | 3722 | D | 7968 | 7657 | 7037 | 6417 |
| Wax C22+ | 6204 | D/N | 6.54 | 4.44 | 2.50 | 1.58 | D/N | 4.73 | 3.84 | 2.69 | 1.98 |

Example 1

Impact of Alpha Value and Hydrocracker Diesel Selectivity on Hydrocracker and Overall D/N Tables 1-4 lists the hydrocracking unit D/N ratio; overall D/N ratio; production rates in tons/day of diesel (D), naphtha (N), wax (W), and of total $C_{5+}$ hydrocarbons from the Fischer-Tropsch (FT) process; production rates in tons/day of D and N from the hydrocracking unit being fed being fed with the wax fraction; and the total production rate of D and N for the overall plant at various hydrocracker diesel selectivities (Diesel Sel.) varying from 60% to 85% with an alpha value of 0.85; 0.89; 0.91 and 0.94 respectively.

An increase in alpha value generally results in a higher overall D/N ratio for a given hydrocracker diesel selectivity. For example, for a diesel selectivity of 70% the overall D/N increases from 2.12 to 2.41 for an alpha change from 0.89 to 0.91. It can be seen that, when the alpha value increases from 0.85 to 0.94, the feed rate to the hydrocracking unit gets bigger, i.e., the capacity of the hydrocracking unit has to increase. However, changing the capacity of an existing unit is limited by its maximum design capacity. So, if one assumes for example that the hydrocracker unit has enough capacity to receive about 3,000-4,000 tons/day of feed; one can see from Tables 2-3, that the alpha value should be around 0.89 to 0.91.

Example 2

Impacts of Alpha Value on Overall D/N Ratio and Production Rates at a 80% Hydrocracker Diesel Selectivity Table 5 shows the impact of the alpha value ranging from 0.79 to 0.94 on the overall D/N ratio; production rates in tons/day of diesel (D), naphtha (N), wax (W), and of total $C_{5+}$ hydrocarbons from the Fischer-Tropsch (FT) process; as well as production rates in tons/day of D and N from the hydrocracking unit and the total production rate of D and N for the overall plant. As the alpha value increases from 0.79 to 0.94, the wax production rate increases from 426 tons/day to 6204 tons/day, while the overall D/N ratio increases from 0.89 to 3.84.

TABLE 5

Alpha value; production rates; and overall D/N ratio at a constant 80% hydrocracker diesel selectivity

| | FT production | | | Overall production | | |
|---|---|---|---|---|---|---|
| alpha | D (t/day) | N (t/day) | W (t/day) | D (t/day) | N (t/day) | D/N |
| 0.79 | 3442 | 4181 | 426 | 3782 | 4258 | 0.89 |
| 0.85 | 4314 | 3112 | 1439 | 5465 | 3371 | 1.62 |
| 0.89 | 4239 | 2152 | 2940 | 6591 | 2681 | 2.46 |
| 0.90 | 4076 | 1894 | 3465 | 6847 | 2518 | 2.72 |
| 0.91 | 3842 | 1634 | 4055 | 7086 | 2364 | 3.00 |
| 0.94 | 2695 | 877 | 6204 | 7657 | 1994 | 3.84 |

TABLE 6

Alpha value impact on hydrocracker D/N ratio and hydrocracker diesel selectivities to maintain overall D/N ratio at about 2.52-2.54.

| | FT production | | | Hydrocracking | | Overall production | | |
|---|---|---|---|---|---|---|---|---|
| alpha | D (t/day) | N (t/day) | W (t/day) | Diesel Sel. (%) | D/N | D (t/day) | N (t/day) | D/N |
| 0.89 | 4239 | 2152 | 2940 | 82 | 5.13 | 6650 | 2622 | 2.54 |
| 0.90 | 4076 | 1894 | 3465 | 76 | 3.45 | 6709 | 2656 | 2.53 |

TABLE 6-continued

Alpha value impact on hydrocracker D/N ratio and hydrocracker diesel selectivities to maintain overall D/N ratio at about 2.52-2.54.

| | FT production | | | Hydrocracking | | Overall production | | |
|---|---|---|---|---|---|---|---|---|
| alpha | D (t/day) | N (t/day) | W (t/day) | Diesel Sel. (%) | D/N | D (t/day) | N (t/day) | D/N |
| 0.91 | 3842 | 1634 | 4055 | 72 | 2.77 | 6761 | 2688 | 2.52 |
| 0.92 | 3533 | 1375 | 4712 | 70 | 2.50 | 6832 | 2694 | 2.54 |
| 0.93 | 3149 | 1121 | 5432 | 68.5 | 2.32 | 6870 | 2723 | 2.52 |
| 0.94 | 2695 | 877 | 6204 | 68 | 2.27 | 6913 | 2739 | 2.52 |

TABLE 7

Alpha value impact on hydrocracker D/N ratio and hydrocracker diesel selectivities to maintain overall D/N ratio at about 2.75.

| | FT production | | | Hydrocracking | | Overall production | | |
|---|---|---|---|---|---|---|---|---|
| alpha | D (t/day) | N (t/day) | W (t/day) | Diesel Sel. (%) | D/N | D (t/day) | N (t/day) | D/N |
| 0.895 | 4166 | 2023 | 3194 | 83.5 | 5.76 | 6833 | 2487 | 2.75 |
| 0.90 | 4076 | 1894 | 3465 | 80.5 | 4.60 | 6865 | 2500 | 2.75 |
| 0.91 | 3842 | 1634 | 4055 | 76 | 3.45 | 6924 | 2526 | 2.74 |
| 0.92 | 3533 | 1375 | 4712 | 73.2 | 2.95 | 6982 | 2543 | 2.75 |
| 0.93 | 3149 | 1121 | 5432 | 71.5 | 2.70 | 7033 | 2561 | 2.75 |
| 0.94 | 2695 | 877 | 6204 | 70.5 | 2.56 | 7068 | 2583 | 2.74 |

Example 3

Impacts of Alpha Value on Hydrocracker Selectivity and D/N Ratio at a Given Overall D/N Ratio Tables 6 and 7 show the impact of the alpha value ranging from 0.89 to 0.94 on production rates of D, N, W from FT process; production rates D and N from the hydrocracking unit and the total production rate of D and N for the overall plant, at a given overall D/N ratio of about 2.53 and about 2.75, respectively. As the alpha value increases from 0.89 to 0.94, in order to maintain the same overall D/N ratio, one has to reduce the hydrocracker selectivity (i.e., increase hydrocracker conversion); and the hydrocracker D/N ratio decreases as the result of a lower conversion.

Example 4

Impacts of Alpha Value on Overall D/N Ratio; Hydrocracker Selectivity and D/N Ratio to Maintain Diesel or Naphtha Production Rates Tables 8 and 9 show the impact of the alpha value ranging from 0.885 to 0.94 on the overall D/N ratio; hydrocracker diesel selectivity and the hydrocracker D/N ratio; production rates of D, N, W from FT process; production rates D and N from the hydrocracking unit and the total production rate of D and N for the overall plant at a given diesel production of about 6,500 tons/day and naphtha production of about 2,700 tons/day, respectively.

As the alpha value increases from 0.89 to 0.94 as shown in Table 8, in order to maintain the same overall diesel production rate, one has to reduce the hydrocracker diesel selectivity; and the hydrocracker D/N ratio decreases as the result of a lower hydrocracker conversion. For illustration, as the alpha value changes from 0.89 to 0.90 and results in an additional 500 tons/day to the hydrocracker, one could decrease the hydrocracker diesel selectivity from 76.9% to about 70% (so as to increase conversion) and maintain the overall diesel production rate of about 6,500 tons/day.

In order to maintain the same overall naphtha production rate as shown in Table 9, as the alpha value increases from 0.89 to 0.94 one has to reduce the hydrocracker diesel selectivity and the hydrocracker D/N ratio decreases as the result of a higher hydrocracker conversion. For illustration, as the alpha value changes from 0.89 to 0.90 and results in about an additional 500 tons/day to the hydrocracking unit, one could decrease the hydrocracker selectivity from 79.4% to about 74.7% (so as to increase conversion) and maintain the same overall naphtha production rate of about 2,700 tons/day.

TABLE 8

D/N ratios for hydrocracking unit and overall plant at various diesel selectivities in hydrocracking unit for a maintained overall diesel production of 6,500 tons/day.

| | FT production | | | Hydrocracking | | Overall production | | |
|---|---|---|---|---|---|---|---|---|
| alpha | D (t/day) | N (t/day) | W (t/day) | Diesel Sel. (%) | D/N | D (t/day) | N (t/day) | D/N |
| 0.885 | 4296 | 2279 | 2702 | 81.6 | 4.98 | 6500 | 2722 | 2.43 |
| 0.89 | 4239 | 2152 | 4239 | 76.9 | 3.64 | 6500 | 2772 | 2.34 |
| 0.90 | 4076 | 1894 | 4076 | 70.0 | 2.50 | 6501 | 2864 | 2.27 |

TABLE 8-continued

D/N ratios for hydrocracking unit and overall plant at various diesel selectivities in hydrocracking unit for a maintained overall diesel production of 6,500 tons/day.

| | FT production | | | Hydrocracking | | Overall production | | |
|---|---|---|---|---|---|---|---|---|
| alpha | D (t/day) | N (t/day) | W (t/day) | Diesel Sel. (%) | D/N | D (t/day) | N (t/day) | D/N |
| 0.91 | 3842 | 1634 | 3842 | 65.6 | 2.02 | 6502 | 2948 | 2.21 |
| 0.92 | 3533 | 1375 | 4712 | 63.0 | 1.80 | 6502 | 3024 | 2.15 |
| 0.93 | 3149 | 1121 | 5432 | 61.7 | 1.70 | 6500 | 3093 | 2.10 |
| 0.94 | 2695 | 877 | 6204 | 61.4 | 1.68 | 6503 | 3149 | 2.07 |

TABLE 9

D/N ratios for hydrocracking unit and overall plant at various diesel selectivities in hydrocracking unit for a maintained overall naphtha production of about 2,700 tons/day.

| | FT production | | | Hydrocracking | | Overall production | | |
|---|---|---|---|---|---|---|---|---|
| alpha | D (t/day) | N (t/day) | W (t/day) | Diesel Sel. (%) | D/N | D (t/day) | N (t/day) | D/N |
| 0.88 | 4338 | 2405 | 4338 | 86.1 | 7.24 | 6473 | 2700 | 2.40 |
| 0.89 | 4239 | 2152 | 4239 | 79.4 | 4.27 | 6574 | 2699 | 2.44 |
| 0.90 | 4076 | 1894 | 4076 | 74.7 | 3.21 | 6664 | 2701 | 2.47 |
| 0.91 | 3842 | 1634 | 3842 | 71.7 | 2.73 | 6749 | 2700 | 2.50 |
| 0.92 | 3533 | 1375 | 4712 | 69.9 | 2.49 | 6827 | 2699 | 2.53 |
| 0.93 | 3149 | 1121 | 5432 | 68.9 | 2.37 | 6892 | 2702 | 2.55 |
| 0.94 | 2695 | 877 | 6204 | 68.6 | 2.33 | 6950 | 2701 | 2.57 |

Example 5

One-Adjustment or Two-Adjustment Methods to Change Overall D/N Weight Ratio of 2.48 to a Desired D/N Weight Ratio of 2.58

Table 10 shows how one could use a one-adjustment approach (Methods 1A and 1B) in changing the overall D/N ratio of the plant to a more desired value by either changing the alpha value of the feed, or changing the hydrocracker diesel selectivity; or a two-adjustment approach (Methods 2A through 2E) by changing both. It is assumed that at a given time the plant status includes an alpha value of 0.9 and a hydrocracker diesel selectivity of 75% which result in a total diesel production of 6,691 tons/day and it is determined that the overall D/N ratio of the plant is 2.48. However, a greater overall D/N ratio of 2.58 has now been selected as being more desired due to a market change, and the margin of 0.1 between the two values is not acceptable to the plant manager.

TABLE 10

One-adjustment or two-adjustment methods to change the overall plant D/N ratio from a value of 2.48 to a desired value of 2.58.

| | | FT production | | | Hydrocracking | | Overall production | | |
|---|---|---|---|---|---|---|---|---|---|
| | | alpha | D (t/day) | N (t/day) | W (t/day) | Diesel Sel. (%) | D/N | D (t/day) | N (t/day) | D/N |
| Plant status | | 0.90 | 4076 | 1894 | 3465 | 75 | 3.26 | 6691 | 2673 | 2.48 |
| 1-adjust | 1A | 0.90 | 4076 | 1894 | 3465 | 77.2 | 3.71 | 6750 | 2615 | 2.58 |
| | 1B | 0.905 | 3968 | 1764 | 3752 | 75 | 3.26 | 6781 | 2627 | 2.58 |
| 2-adjust. | 2A | 0.89 | 4239 | 2152 | 2940 | 83.4 | 5.71 | 6691 | 2581 | 2.59 |
| | 2B | 0.895 | 4166 | 2023 | 3194 | 79.8 | 4.38 | 6715 | 2023 | 2.58 |
| | 2C | 0.903 | 4013 | 1816 | 3635 | 75.8 | 3.41 | 6768 | 2623 | 2.58 |
| | 2D | 0.907 | 3919 | 1712 | 3871 | 74.2 | 3.12 | 6792 | 2633 | 2.58 |
| | 2E | 0.91 | 4055 | 1634 | 3842 | 73.2 | 2.95 | 6810 | 2639 | 2.58 |

In one of the one-adjustment approach (Method 1A) shown in Table 10, the conditions in the FT process would not be changed so as to maintain the same alpha value of 0.9, but in order to increase the overall D/N ratio to the desired value of 2.58, one would have to increase the hydrocracker diesel selectivity from 75% to 77.2%; this increase in the hydrocracker diesel selectivity will result in producing more diesel (6,750 versus 6,691 tons/day for overall production) and achieve an overall D/N of 2.58. In another one-adjustment approach (Method 1B), the conditions in the hydrocracker would not be changed so as to maintain the same hydrocracker diesel selectivity of 75%. So in order to increase the overall D/N ratio towards the desired value of 2.58, one would change at least one promoting condition in the FT process so as to increase the alpha value from 0.9 to 0.905. This increase in the alpha value will result in producing more diesel (6781 versus 6691 tons/day for overall production) while obtaining the desired overall D/N of 2.58.

In one of the two-adjustment approach (Methods 2A and 2B) shown in Table 10, the conditions in the FT process are such that an alpha value to 0.9 could not be maintained and instead the alpha value drops to 0.895 or 0.89; this results in 250 or 500 tons/day less to be fed to the hydrocracker. So in order to increase the overall D/N ratio to reach the desired value of 2.58 or approach it within an acceptable margin (for example set to 0.02 by the plant manager), one would have to increase the hydrocracker diesel selectivity from 75% to 79.4% or 83.4% respectively; this increase in the hydrocracker diesel selectivity and the decrease in alpha value will result in producing slightly higher or similar overall diesel production rate while obtaining an overall D/N 2.59 and 2.58 within an acceptable margin (0.02) of the desired value (2.58).

In another two-adjustment approach (Method 2C) shown in Table 10, at least one conversion promoting condition in the FT process could be changed so as to increase the alpha value from 0.9 to 0.903; this results in an additional 200 tons/day to be fed to the hydrocracker. In order to increase the overall D/N ratio to approach within an acceptable margin (0.02) or reach the desired value of 2.58, one would have to slightly increase the hydrocracker diesel selectivity from 75% to 75.8%; this slight increase in the hydrocracker diesel selectivity and slight increase in alpha will result in generating a slightly higher overall diesel production rate (6,768 tons/day) while obtaining the desired overall D/N of 2.58.

In other two-adjustment approaches (Methods 2D and 2E) shown in Table 10, the conditions in the FT process could be adjusted so as to effect a higher increase in the alpha value from 0.9 to 0.907 or 0.91 respectively; this results in about an additional 400 tons/day to be fed to the hydrocracker. In order to increase the overall D/N ratio to the desired value of 2.58, one would have to decrease the hydrocracker diesel selectivity from 75% to 74.2% or 73.2% respectively; this decrease in the hydrocracker diesel selectivity and increase in alpha will result in generating slightly higher overall diesel production rates while obtaining the desired overall D/N of 2.58.

While the preferred embodiments of the invention have been shown and described, modifications thereof can be made by one skilled in the art without departing from the spirit and teachings of the invention. The embodiments described herein are exemplary only and are not intended to be limiting. Many variations and modifications of the invention disclosed herein are possible and are within the scope of the invention. The disclosures of all patents, patent applications, and publications cited above are incorporated herein by reference.

The invention claimed is:

1. A method for optimizing the operation of a hydrocracker for the production of synthetic diesel and naphtha derived from a Fischer-Tropsch process, the method comprising the steps of:

(a) providing a synthetic heavy hydrocarbon feed characterized by a 5% boiling point equal to or greater than 600° F., wherein the synthetic heavy hydrocarbon feed is derived from a Fischer-Tropsch reaction product, the Fischer-Tropsch reaction product being characterized by an $\alpha$;

(b) reacting the synthetic heavy hydrocarbon feed with hydrogen in a hydrocracker under conversion promoting conditions so as to form a hydrocracked effluent comprising a middle distillate and a light distillate;

(c) determining a target molar ratio of hydrocarbon molecules exiting the hydrocracker to hydrocarbon molecules entering the hydrocracker, said determination being based on the synthetic heavy hydrocarbon feed $\alpha$ and a desired hydrocracked effluent property; and (d) adjusting at least one hydrocracker conversion promoting condition so as to approach the target molar ratio of hydrocarbon molecules exiting the hydrocracker to hydrocarbon molecules entering the hydrocracker.

2. The method according to claim 1 wherein the Fischer-Tropsch reaction product $\alpha$ is between about 0.85 and about 0.94.

3. The method according to claim 1 wherein the Fischer-Tropsch reaction product $\alpha$ is between about 0.87 and about 0.92.

4. The method according to claim 1 wherein the middle distillate is diesel and wherein the light distillate is naphtha.

5. The method according to claim 4 wherein the desired hydrocracked effluent property is a diesel/naphtha weight ratio between about 0.6 and about 8.

6. The method according to claim 4 wherein the desired hydrocracked effluent property is a diesel/naphtha weight ratio between about 1.5 and about 6.5.

7. The method according to claim 4 wherein the desired hydrocracked effluent property is a diesel/naphtha weight ratio between about 2 and about 5.

8. The method according to claim 1 wherein the molar ratio of hydrocarbon molecules exiting the hydrocracker to hydrocarbon molecules entering the hydrocracker is between about 2 and about 5.

9. The method according to claim 1 wherein the heavy fraction in the feedstream is characterized by a 5% boiling point equal to or greater than 640° F.

10. The method according to claim 1 wherein the conversion promoting conditions in step (b) comprise a temperature between about 260° C. and about 400° C.

11. The method according to claim 10 wherein the conversion promoting conditions in step (b) further comprise a pressure between about 3.5 MPa and about 10.5 MPa.

12. The method according to claim 10 wherein the conversion promoting conditions in step (b) further comprise a hydrogen-to-hydrocarbon feed ratio between about 100 and about 10,000 standard cubic feet per barrel of hydrocarbon feed.

13. The method according to claim 1 wherein step (d) comprises adjusting one hydrocracking conversion promoting condition selected from the group consisting of hydrocracking temperature; hydrocracking pressure; hydrogen flow per barrel of hydrocarbon feed; liquid hourly space velocity; and any combination of two or more thereof.

14. The method according to claim 1 wherein step (d) comprises adjusting the temperature in the hydrocracker.

15. A method for operating a hydrocracker processing a synthetic heavy hydrocarbon fraction derived from a Fischer-Tropsch reaction product, the method comprising the steps of:

(a) reacting a synthesis gas under conversion promoting conditions so as to form a synthetic hydrocarbon product, wherein the synthetic hydrocarbon product comprises a Fischer-Tropsch reaction product having a hydrocarbon composition characterized by an $\alpha$;

(b) providing a feedstream comprising at least a heavy fraction of said synthetic hydrocarbon product, wherein the heavy fraction of said synthetic hydrocarbon product in the feedstream is characterized by a 5% boiling point equal to or greater than 600° F.;

(c) reacting the feedstream with hydrogen in a hydrocracker under conversion promoting conditions so as to form a hydrocracked effluent comprising a middle distillate and a light distillate;

(d) selecting a desired middle distillate/light distillate ratio for the hydrocracked effluent;

(e) calculating a desired molar ratio of hydrocarbons exiting the hydrocracker to hydrocarbons entering the hydrocracker, said calculation being based on the desired middle distillate/light distillate ratio and the Fischer-Tropsch reaction product $\alpha$; and (f) adjusting at least one conversion promoting condition of the hydrocracker so as to achieve the desired molar ratio of hydrocarbons exiting the hydrocracker to hydrocarbons entering the hydrocracker.

16. The method according to claim 15 wherein the Fischer-Tropsch reaction product $\alpha$ is between about 0.85 and about 0.94.

17. The method according to claim 15 wherein the Fischer-Tropsch reaction product $\alpha$ is between about 0.87 and about 0.92.

18. The method according to claim 15 wherein the middle distillate is diesel and wherein the light distillate is naphtha.

19. The method according to claim 18 wherein the desired diesel/naphtha ratio is a weight ratio between about 0.6 and about 8.

20. The method according to claim 18 wherein the desired diesel/naphtha ratio is a weight ratio between about 1.5 and about 6.5.

21. The method according to claim 15 wherein the molar ratio of hydrocarbons exiting the hydrocracker to hydrocarbons entering the hydrocracker is between about 2 and about 5.

22. The method according to claim 15 wherein the heavy fraction in the feedstream is characterized by a 5% boiling point equal to or greater than 640° F.

23. The method according to claim 15 wherein the conversion promoting conditions in step (a) comprise a temperature between about 260° C. and about 400° C.

24. The method according to claim 15 wherein the conversion promoting conditions in step (a) further comprise a pressure between about 3.5 MPa and about 10.5 MPa.

25. The method according to claim 15 wherein the conversion promoting conditions in step (a) further comprise a hydrogen-to-hydrocarbon feed ratio between about 100 and about 10,000 standard cubic feet per barrel of hydrocarbon feed.

26. The method according to claim 15 wherein step (f) comprises adjusting one hydrocracking conversion promoting condition selected from the group consisting of hydrocracking temperature; hydrocracking pressure; hydrogen flow per barrel of hydrocarbon feed; liquid hourly space velocity; and any combination of two or more thereof.

27. The method according to claim 15 wherein step (f) comprises adjusting the temperature in the hydrocracker.

28. The method for adjusting the overall production of a plant converting syngas to hydrocarbon products preferably comprises the following steps of:

a) converting a synthesis gas comprising hydrogen and carbon monoxide in a Fischer-Tropsch reactor under conversion promoting conditions so as to form a Fischer-Tropsch hydrocarbon product comprising $C_{5+}$ hydrocarbons, wherein the Fischer-Tropsch hydrocarbon product comprises a light distillate, a middle distillate and a heavy fraction, said heavy fraction being characterized by an $\alpha$ value;

b) converting the heavy fraction with hydrogen in a hydrocracker under hydrocracking conversion promoting conditions so as to produce a hydrocracked effluent, wherein the hydrocracked effluent comprises a middle distillate and a light distillate, and the hydrocracked effluent is characterized by a hydrocracker middle distillate-to-light distillate ratio;

c) periodically determining an overall middle distillate-to-light distillate ratio for the plant based on the ratio of the total production of middle distillates from steps (a) and (b) to the total production of light distillates from steps (a) and (b);

d) selecting a desired overall middle distillate-to-light distillate ratio;

e) maintaining the overall middle distillate-to-light distillate ratio within a predetermined range of the desired overall middle distillate-to-light distillate ratio by adjusting either or both of:

1) at least one hydrocracking conversion promoting condition within the hydrocracker so as to effect a change in the hydrocracker middle distillate-to-light distillate ratio; and 2) at least one conversion promoting condition within the Fischer-Tropsch reactor so as to effect a change in the $\alpha$ value of the heavy fraction.

29. The method according to claim 28 wherein step (e) comprises adjusting one hydrocracking conversion promoting condition selected from the group consisting of hydrocracking temperature; hydrocracking pressure; hydrogen flow per barrel of hydrocarbon feed; liquid hourly space velocity; and any combination of two or more thereof.

30. The method according to claim 29 wherein the hydrocracking conversion promoting condition comprises a temperature between about 260° C. and about 400° C.

31. The method according to claim 30 wherein the hydrocracking conversion promoting condition comprises a hydrogen flow between about 100 standard cubic feet of hydrogen per barrel of hydrocarbon feed and about 10,000 scf $H_2$/bbl HC; and a liquid hourly space velocity between 0.1 and 10 $hr^{-1}$.

32. The method according to claim 28 wherein step (e) comprises adjusting one conversion promoting condition within the Fischer-Tropsch reactor selected from the group consisting of reactor temperature; inlet hydrogen-to-carbon monoxide molar ratio; reactor pressure; recycle ratio; reactor per-pass conversion; gas hourly space velocity; and any combination of two or more thereof.

33. The method according to claim 32 wherein the conversion promoting conditions within the Fischer-Tropsch reactor comprise a temperature between 190° C. and 260° C.; a reactor pressure between 250 psig and 650 psig; a recycle ratio between about 0.1:1 and about 10:1; an inlet hydrogen-to-carbon monoxide molar ratio between 1.4:1 and 2.3:1; and a reactor per-pass CO conversion between 30% and 70%.

34. The method according to claim 28 wherein step (e) comprises 1) adjusting at least one hydrocracking conversion promoting condition and 2) adjusting at least one conversion promoting condition within the Fischer-Tropsch reactor.

35. The method according to claim 34 wherein the adjustments are performed simultaneously.

36. The method according to claim 34 wherein the adjustments are performed in a sequential manner.

37. The method according to claim 28 wherein the predetermined range of the desired overall middle distillate-to-light distillate ratio is within 8% of the desired overall middle distillate-to-light distillate ratio.

38. The method according to claim 28 wherein the hydrocracker middle distillate-to-light distillate ratio is a weight ratio ranging from about 1:1 to about 8:1.

39. The method according to claim 28 wherein the desired overall middle distillate-to-light distillate ratio is a weight ratio ranging from about 1:1 to about 5:1.

40. The method according to claim 28 wherein the middle distillate is a diesel and the light distillate is a naphtha.

41. The method according to claim 40 wherein the overall diesel-to-naphtha ratio is a weight ratio ranging from about 1.4:1 to about 4:1.

42. The method according to claim 40 wherein the hydrocracker diesel-to-naphtha ratio is a weight ratio ranging from about 1.5:1 to about 6.5:1.

43. The method according to claim 40 wherein the change in the $\alpha$ value is less than 0.01.

44. The method according to claim 28 wherein the $\alpha$ value of the heavy fraction is between about 0.85 and about 0.94.

45. The method according to claim 28 wherein the $\alpha$ value of the heavy fraction is between about 0.87 and about 0.92.

* * * * *